US005520074A

United States Patent [19]

Swindell, Sr.

[11] Patent Number: 5,520,074

[45] Date of Patent: May 28, 1996

[54] WRENCH WITH SEPERABLE ENDS

[75] Inventor: Timothy L. Swindell, Sr., Needmore, Pa.

[73] Assignee: Tonoloway Tack Drivers, Inc., Needmore, Pa.

[21] Appl. No.: 276,794

[22] Filed: Jul. 18, 1994

[51] Int. Cl.[6] ..... B25B 13/02; B25B 23/16

[52] U.S. Cl. ..... 81/125.1; 81/177.2

[58] Field of Search ..... 81/119, 124.3, 81/124.4, 124.7, 177.1, 177.75, 177.8, 177.85, 125.1, 177.2

[56] References Cited

U.S. PATENT DOCUMENTS 4,596,167 6/1986 White ..... 81/177.2

FOREIGN PATENT DOCUMENTS 367354 8/1906 France ..... 81/177.85
555340 3/1923 France ..... 81/177.85
559823 3/1944 United Kingdom ..... 81/177.85

*Primary Examiner*—James G. Smith

[57] ABSTRACT

A wrench with separable ends comprising of a wrench half having an exterior end with a bolt grasping component secured thereto and having an interior end with a bowtie shaped coupling component, the height of the handle and being essentially the same along the majority of its length. A cylindrical sliding sheath supported over the wrench halves and movable to a position along its length and movable to a position overlying the coupling component to effect a secure coupling during operation and use.

1 Claim, 4 Drawing Sheets

WRENCH WITH SEPERABLE ENDS

BACKGROUND OF THE INVENTION

1. Field of the Invention

The present invention relates to a wrench with seperable ends and more particularly pertains to selectively coupling or uncoupling a pair of wrench halves to allow use together or independently at the discretion of the user.

2. Description of the Prior Art

The use of wrenches and other tools of a wide variety of designs and configurations is known in the prior art. More specifically, wrenches and other tools of a wide variety of designs and configurations heretofore devised and utilized for the purpose of joining or seperating tools and their component elements as may be desired through a wide variety of designs and configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,193,419 to Lee a wrench with telescopic handle.

U.S. Pat. No. 4,787,275 to Colvin discloses an adjustable double ended box wrench.

U.S. Pat. No. 4,058,032 to Jacks discloses an open end wrench.

U.S. Pat. No. 296,292 to Schoepe the design of a separable box wrench.

U.S. Pat. No. 273,454 to Pyles the design of a an open end wrench.

In this respect, the wrench with seperable ends according to the present invention substantially departs from the conventional concepts and designs of the prior art, and in doing so provides an apparatus primarily developed for the purpose of selectively coupling or uncoupling a pair of wrench halves to allow use together or independently at the discretion of the user.

Therefore, it can be appreciated that there exists a continuing need for new and improved wrench with seperable ends which can be used for selectively coupling or uncoupling a pair of wrench halves to allow use together or independently at the discretion of the user. In this regard, the present invention substantially fulfills this need.

SUMMARY OF THE INVENTION

In view of the foregoing disadvantages inherent in the known types of wrenches and other tools of a wide variety of designs and configurations now present in the prior art, the present invention provides an improved wrench with seperable ends. As such, the general purpose of the present invention, which will be described subsequently in greater detail, is to provide a new and improved wrench with seperable ends and method which has all the advantages of the prior art and none of the disadvantages.

To attain this, the present invention essentially comprises a first wrench half having an exterior end with a crescent secured thereto and having an interior end with a bowtie shaped projection, the height of the handle and being essentially the same along its length, except at the crescent. A second wrench half having an exterior end with a box secured thereto and having an interior end, the interior end being undercut with a recess in the shape of a bowtie for receiving the bowtie shaped projection of the first wrench half. A cylindrical sliding sheath supported over one of the wrench halves and movable to a position along the length of its supporting wrench half and movable to a position overlying the projection and recess to effect their secure coupling therebetween during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wrench with seperable ends which have all the advantages of the prior art wrenches and other tools of a wide variety of designs and configurations and none of the disadvantages.

It is another object of the present invention to provide a new and improved wrench with seperable ends which may be easily and efficiently manufactured and marketed.

It is further object of the present invention to provide a new and improved wrench with seperable ends which are of durable and reliable constructions.

An even further object of the present invention is to provide a new and improved wrench with seperable ends which are susceptible of a low cost of manufacture with regard to both materials and labor, and which accordingly are then susceptible of low prices of sale to the consuming public, thereby making such wrench with seperable ends economically available to the buying public.

Still yet another object of the present invention is to provide a new and improved wrench with seperable ends which provide in the apparatuses and methods of the prior art some of the advantages thereof, while simultaneously overcoming some of the disadvantages normally associated therewith.

Still another object of the present invention is to selectively couple or uncouple a pair of wrench halves to allow use together or independently at the discretion of the user.

Lastly, it is an object of the present invention to provide a new and improved wrench with separable ends comprising of a wrench half having an exterior end with a bolt grasping component secured thereto and having an interior end with a bowtie shaped coupling component, the height of the handle and being essentially the same along the majority of its length. A cylindrical sliding sheath supported over the wrench halves and movable to a position along its length and movable to a position overlying the coupling component to effect a secure coupling during operation and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
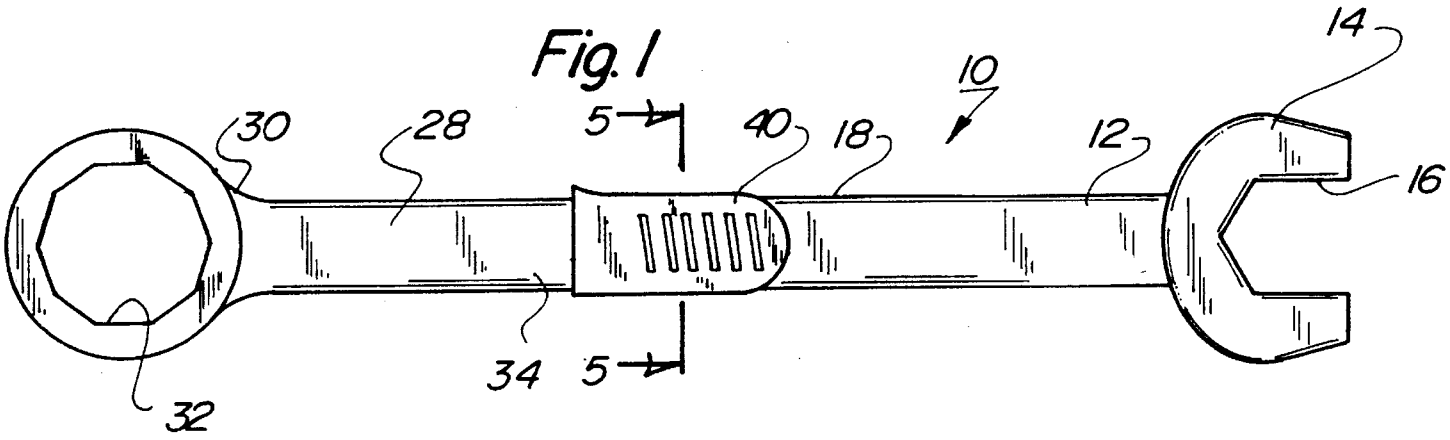
FIG. 1 is a front elevational view of the preferred embodiment of the wrench with seperable ends constructed in accordance with the principles of the present invention.

With reference now to the drawings, and in particular to FIG. 1 thereof, the preferred embodiment of the new and improved wrench with separable ends embodying the principles and concepts of the present invention and generally designated by the reference numeral 10 will be described.

The invention, the wrench with separable ends is comprised of a plurality of components. In their broadest context, such components include a first wrench half, a second wrench half and a sliding sheath as well as, in an alternate embodiment, a torque handle. Such components are specifically configured and correlated with respect to each other so as to attain the desired objective.

The first major component of the system 10 of the primary embodiment as shown in FIGS. 1 through 5 is a first major wrench half 12. Such wrench half has an exterior end 14 with a first bolt grasping component 16 in the shape of a crescent secured thereto. The first wrench half also has an interior end 18. The interior end is formed with a bowtie shaped projection 20. The bowtie has a narrow center 22 with angled intermediate regions terminating in enlarged opposite ends 24. The centers of the enlarged ends as well as the center of the central section are aligned with the axis of the wrench half. The height of the handle is essentially the same along its length except at the crescent shaped grasping component. Further, the end with the bowtie projection is shaped so that the surfaces of the wrench half are parallel with the surfaces of the bowtie projection and extensions of the central section of the wrench half.

The next component of the system 10 is a second wrench half 28. Such second wrench half has an exterior end 30 with a bolt grasping component 32 in the form of a box head secured thereto. It should be understood that other bolt grasping shapes could be readily utilized and be the same as or different from those of the wrench half with which it is utilized. The second wrench half also has an interior end 34. The interior end is undercut to render it of a lesser height than the majority of the length of the second wrench half. The second and first wrench halves are of essentially the same heights except at the bolt grasping ends. The interior end at the undercut section is formed with a recess 36. The recess is in the shaped of a bowtie of a size and shape corresponding to that of the projection. The recess is for receiving the bowtie shaped projection of the first wrench half. The recess may extend a predetermined distance into the undercut portion of the second wrench half. It is preferred, however, that the recess extend all the way through for maximum coupling in receiving the bowtie.

Figure 2:
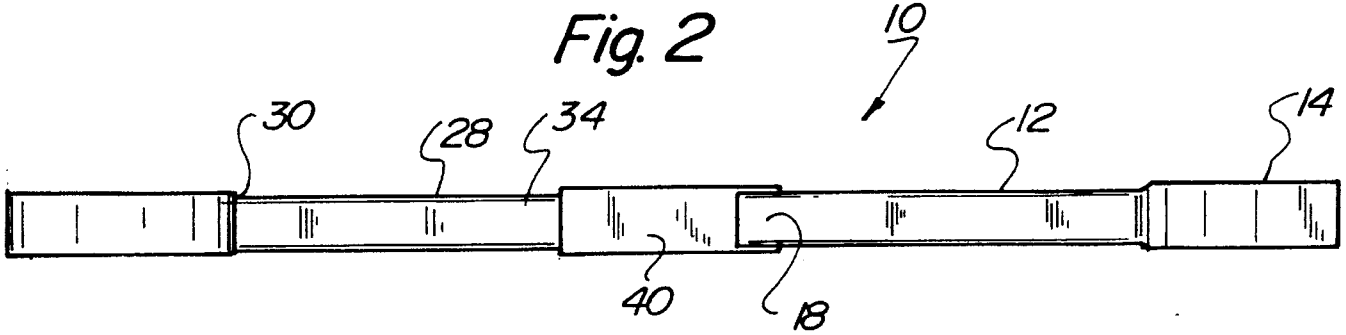
FIG. 2 is a side elevational view of the wrench shown in FIG. 1.
Figure 3:
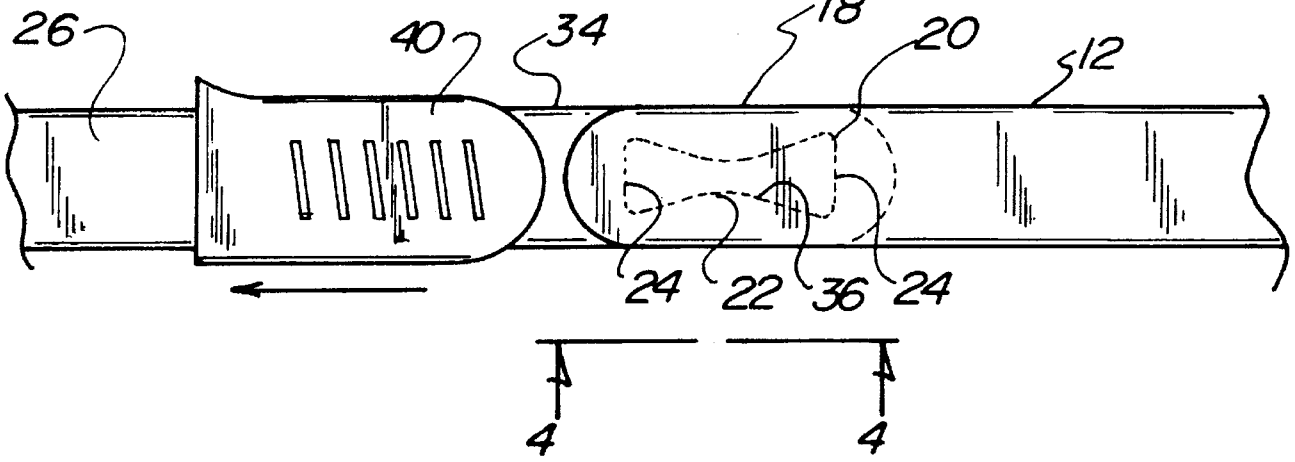
FIG. 3 is an enlarged front elevational view of the area of coupling between the wrench halves of the prior Figure.
Figure 4:
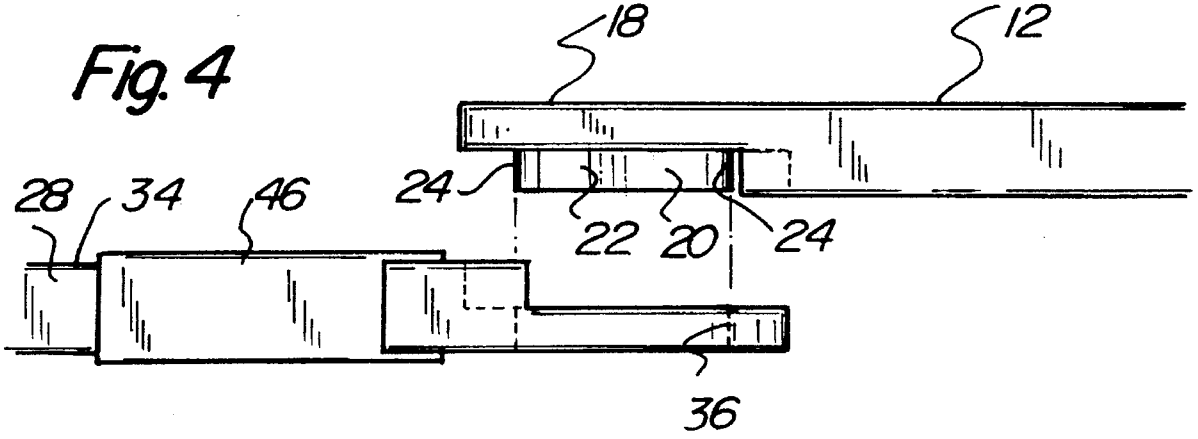
FIG. 4 is an exploded side elevational view taken along line 4—4 of FIG. 3.
Figure 5:
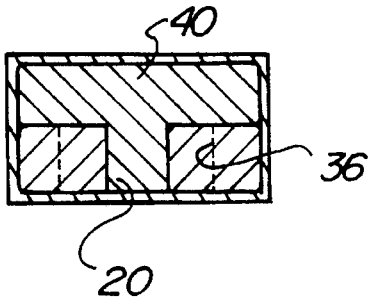
FIG. 5 is a cross sectional view taken along 5—5 of FIG. 1
Figure 6:
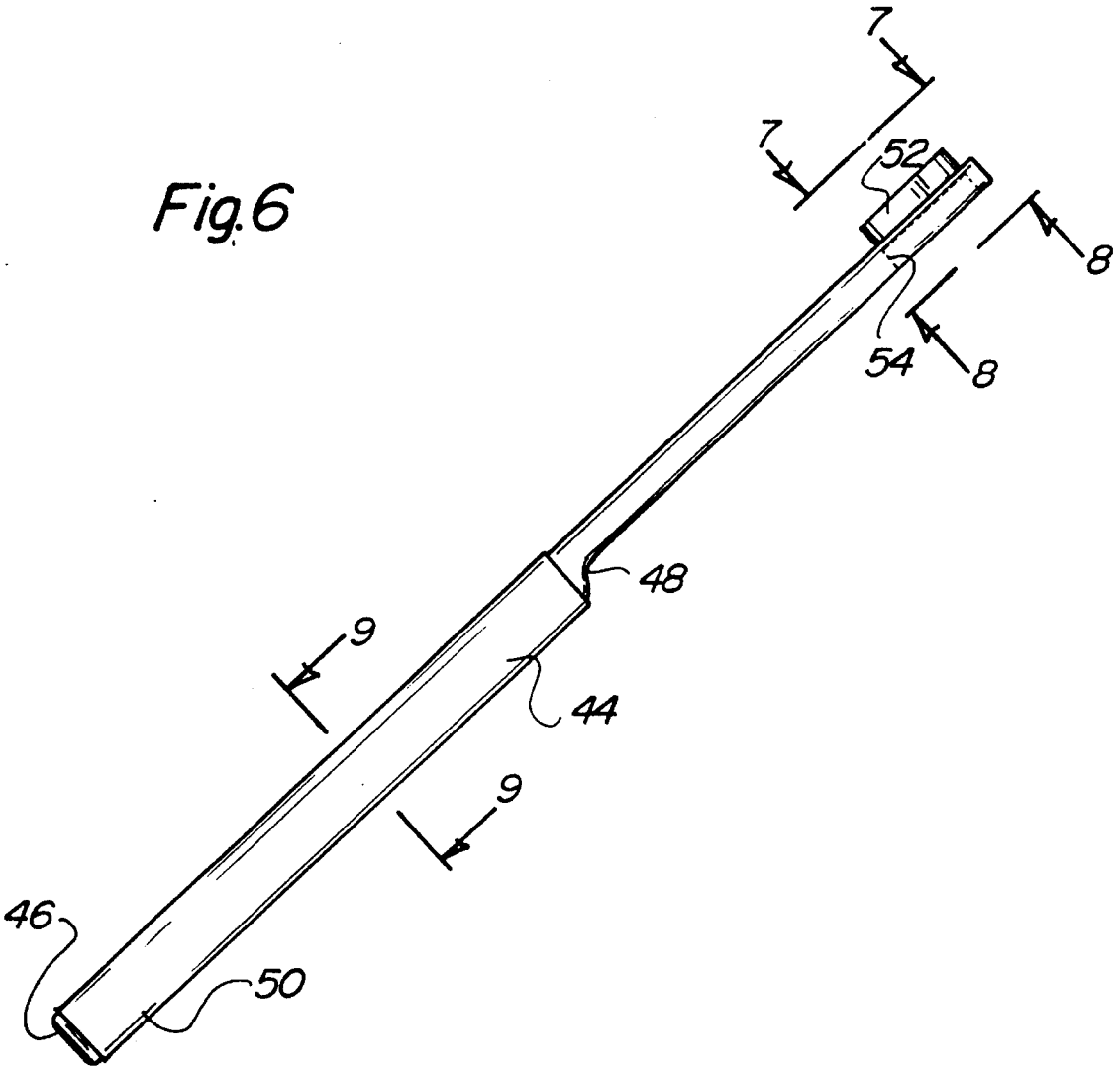
FIG. 6 is a side elevational view of a torque handle adapted to be used in association with either of the wrench halves illustrated in FIGS. 1 and 2.
Figure 7:
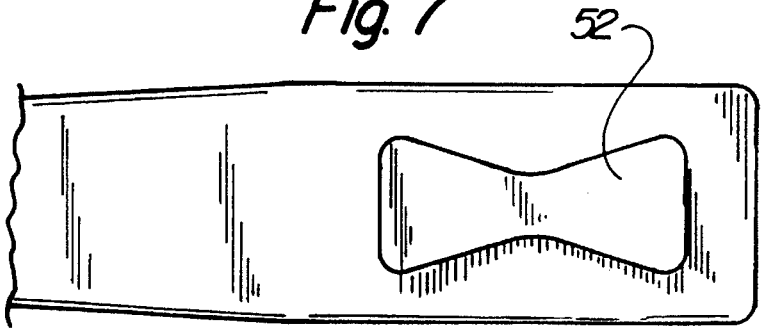
FIG. 7 is a front elevational view taken along line 7—7 of FIG. 6.
Figure 8:
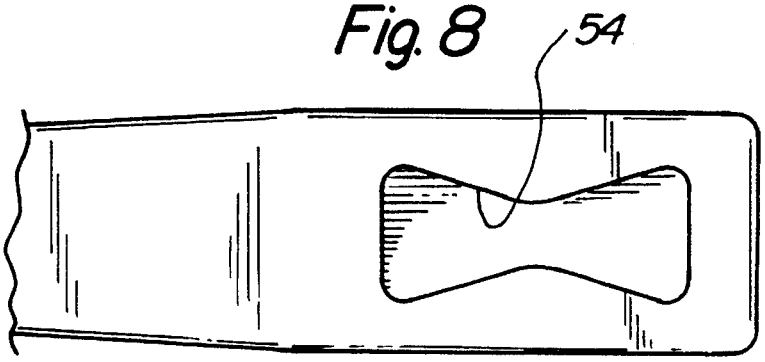
FIG. 8 is a front elevational view taken along line 8—8 of FIG. 6.
Figure 9:
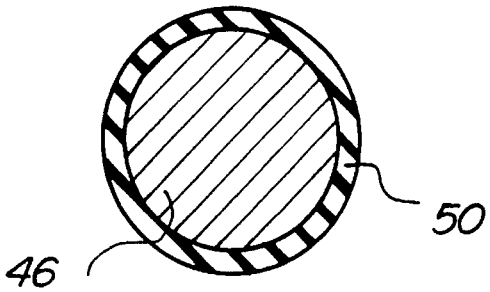
FIG. 9 is a cross sectional view taken along line 9—9 of FIG. 6.

The third component of the system 10 is a generally cylindrical or rectangular sliding sheath 40. The sheath is supported over one of the wrench halves. It is movable by sliding along the length of its supporting wrench half to any of a plurality of positions. In the operative position, the sheath is movable to an orientation as shown in FIGS. 1 and 2 for overlying the projection and the recess to effect their secure coupling therebetween during operation and use. The inoperative position is shown in FIGS. 3 and 4 to allow the coupling and uncoupling of the first and second wrench halves. The wrench halves are preferably formed of a high carbon tool steel. They are each formed of a one piece construction. The sheath is preferably formed of a stiff plastic material in a cylindrical configuration with its interior surface substantially the shape of the first and second wrench halves over the majority of their extent which halves are of the same cross sectional configuration.

An alternate embodiment of the invention as shown in FIGS. 6, 7, 8 and 9. In such alternate embodiment, there is provided a torque handle 44. Such torque handle has an interior end 46 and an exterior end 48. The exterior end has a cylindrical cross section shown, preferably, in FIG. 9 as being circular. It is provided with an elastomeric cylindrical sleeve 50 thereover. The sleeve is such as to increase gripping ability by a user during operation and use. The interior end is formed with a bowtie shaped projection 52 on one face. Such projection is positionable in a bowtie shaped recess of a wrench half as of the prior embodiment. The wrench half would be provided with a sheath as in the prior embodiment to effect coupling between the torque handle and the wrench half. The torque handle is also formed with a bowtie shaped recess 54 on the opposite face of the torque handle adjacent to the projection. The recess is adapted to receive the bowtie shaped projection of a wrench half as in the primary embodiment. Once again, a sheath would be utilized to effect the coupling therebetween. In this alternate embodiment, the recess does not extend entirely through the associated end of the torque handle. Instead, it extends inwardly only to an extent and distance essentially equal to the extent that the projection of the wrench half extends from its associated surface.

The present invention is a box and/or open end wrench which is made in two independent sections. It is split at the approximate midpoint of its length, and the thickness of the handle is reduced to approximately half of the normal thickness for a short distance near each end. A raised drive, shaped in an outline which is similar to the shape of a bowtie, is formed on the recessed surface of one section, and a similarly shaped receptacle is formed on the other section.

As these two sections are overlapped and joined, the "bowtie" drives will be snugly mated, and the original thickness of the one-piece handle will be restored. A sliding sheath-like clip can then be moved into place to completely encompass the mated drives and essentially form aa conventional wrench with a box drive at one end and an open end wrench at the other.

The advantage of this arrangement is that the tool or tools can be joined and used in a normal fashion, or they can be separated and used individually if one is to work in restricted areas. Anyone who has used this type of wrench will attest to the fact that a "half length" wrench will be extremely valuable in areas which will not accommodate a full length standard wrench.

Like its conventional counterpart the present invention can be made in all of the popular SAE and metric sizes, and the unique and positive mating drive makes the use of a handy accessory possible, a torque handle, which is part of the set. This handle is twelve inches long and had a non skid rubber grip. The business end has a raised bowtie drive on one side and a recessed drive on the other. In this fashion, it can be used to drive either member of the mating wrench sections. The present invention should be a valuable acquisition for anyone having the need to work with these types of wrenches.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wrench with separable ends comprising, in combination:

a first wrench half having an exterior end with a crescent shaped grasping component secured thereto and having an interior end with a bowtie shaped projection, the first wrench half having a height and being essentially the same along a length thereof, except at the crescent shaped grasping component;

a second wrench half having an exterior end with a box head secured thereto and having an interior end, the interior end being undercut with a recess in the shape of a bowtie for receiving the bowtie shaped projection of the first wrench half, the recess extending all the way through the interior end of the second wrench half for maximum coupling, the second wrench half coupling the first wrench half by way of the recess having essentially a uniform height throughout a length of the coupled wrench halves excluding each exterior end;

a sliding sheath being generally rectangular in shape, the sheath capable of being supported over either of the wrench halves and movable to a position along the length of which ever of the wrench halves being supportive thereof during use, and movable to a position overlying the projection and recess to effect secure coupling between the first wrench half and the second wrench during operation and use; and a torque handle having an interior end and an exterior end, the exterior end having a cylindrical cross section with an elastomeric cylindrical sleeve thereover, the interior end being formed with a bowtie type shaped projection on one face positionable in a bowtie shaped recess of the second wrench half and having a bowtie shaped recess on the opposite face adapted to receive the bowtie shaped projection of the first wrench half, the sheath being positionable to effect coupling of the torque handle with either of the wrench halves.

* * * * *